US011564544B2

(12) United States Patent
Roschi

(10) Patent No.: US 11,564,544 B2
(45) Date of Patent: Jan. 31, 2023

(54) ADAPTER DEVICE FOR A CORDLESS ELECTRIC VACUUM CLEANER

(71) Applicant: NEW ERMES EUROPE S.r.l., Crosio Della Valle (IT)

(72) Inventor: Riccardo Roschi, Crosio Della Valle (IT)

(73) Assignee: NEW ERMES EUROPE S.r.l., Crosio Della Valle (IT)

( * ) Notice: Subject to any disclaimer, the term of this patent is extended or adjusted under 35 U.S.C. 154(b) by 0 days.

(21) Appl. No.: 17/159,784

(22) Filed: Jan. 27, 2021

(65) Prior Publication Data

US 2021/0228038 A1 Jul. 29, 2021

(30) Foreign Application Priority Data

Jan. 28, 2020 (IT) ..... 102020000001555

(51) Int. Cl.
*A47L 9/24* (2006.01)
*A47L 9/02* (2006.01)

(52) U.S. Cl.
CPC ..... *A47L 9/242* (2013.01); *A47L 9/02* (2013.01)

(58) Field of Classification Search
CPC ..... A47L 9/242; A47L 9/24; A47L 9/248
USPC ..... 15/246.2; 285/7
See application file for complete search history.

(56) References Cited

U.S. PATENT DOCUMENTS

| | | | | |
|---|---|---|---|---|
| 24,222 | A | 5/1859 | McBurney | |
| 395,671 | A | 1/1889 | Thayer | |
| 428,023 | A | 5/1890 | Schoff | |
| 809,977 | A | 1/1906 | O'Brien | |
| 1,153,187 | A | 9/1915 | Berry | |
| 1,434,631 | A | 11/1922 | Reynolds | |
| 1,560,789 | A | 11/1925 | Johnson et al. | |
| 2,203,088 | A | 6/1940 | Hansson | |
| 2,249,463 | A | 7/1941 | Dunbar | |
| 2,416,418 | A | 2/1947 | Taylor | |
| 2,627,623 | A | 2/1953 | Humphrey | |
| 2,688,499 | A * | 9/1954 | Hanson | F16L 37/48 277/615 |

(Continued)

FOREIGN PATENT DOCUMENTS

| | | |
|---|---|---|
| AT | 383 264 | 6/1987 |
| DE | 16 28 579 A | 2/1971 |

(Continued)

OTHER PUBLICATIONS

DE-2332846-A1 translation from Espacenet (Year: 2021).*

(Continued)

*Primary Examiner* — Joseph J Hail
*Assistant Examiner* — Timothy Brady
(74) *Attorney, Agent, or Firm* — Nixon & Vanderhye P.C.

(57) ABSTRACT

It is disclosed an adapter device for a vacuum cleaner comprising a hollow tubular body comprising a first end configured to engage a part of the vacuum cleaner and a second end configured to engage an accessory or a flexible tube, wherein the hollow tubular body is at least partially of a deformable material with elastic return and comprises a ring protruding radially outwards from the external surface of the tubular body. The adapter device could comprise a plurality of rings protruding radially outwards from the external surface of the tubular body. The rings of the plurality of rings could have an increasing diameter.

14 Claims, 3 Drawing Sheets

(56) References Cited

U.S. PATENT DOCUMENTS 2,699,357 A * 1/1955 Roth ..... B05B 1/044 239/516
2,915,774 A 12/1959 Darrow
3,245,228 A 4/1966 Stuemky et al.
3,266,059 A 8/1966 Telle
3,855,666 A 12/1974 Erikson et al.
4,173,989 A * 11/1979 Prest ..... F16L 25/14 285/179
4,319,379 A 3/1982 Carrigan et al.
D264,139 S 4/1982 Pearman, Jr.
4,336,628 A 6/1982 Bradshaw et al.
4,564,972 A 1/1986 Varin
D290,418 S 6/1987 Strohmeyer
4,722,556 A * 2/1988 Todd ..... E03F 1/008 285/179
D296,372 S 6/1988 Toney
4,777,696 A 10/1988 Hawley et al.
4,779,904 A * 10/1988 Rich ..... F16J 15/3288 285/8
4,866,565 A * 9/1989 Wray, Jr. ..... A47L 9/24 361/215
D306,788 S 3/1990 McAllister
4,997,209 A * 3/1991 McGrath ..... A47L 9/242 285/332
5,008,973 A 4/1991 Worwag
5,050,266 A * 9/1991 Schneider ..... A47L 9/242 15/375
5,069,569 A 12/1991 Lieser
D331,991 S 12/1992 Wright
D333,539 S 2/1993 Kramer et al.
5,249,333 A 10/1993 Worwag
5,293,665 A 3/1994 Worwag
5,416,948 A 5/1995 Worwag
5,539,953 A 7/1996 Kurz
5,605,356 A * 2/1997 Salvi ..... F16L 37/02 285/38
5,635,675 A 6/1997 Houga
D392,779 S 3/1998 Fedorka
D392,780 S 3/1998 Holsten et al.
5,740,839 A 4/1998 Kuo et al.
5,768,747 A 6/1998 Smith
5,826,300 A 10/1998 Smith
5,875,517 A 3/1999 Fust et al.
D424,766 S 5/2000 Martin
6,101,668 A 8/2000 Grey
D456,967 S 5/2002 Santiago
D457,696 S 5/2002 Worwag
6,408,888 B1 6/2002 Baumer et al.
D466,499 S 12/2002 Nakano
6,519,810 B2 2/2003 Kim
6,561,550 B1 * 5/2003 Kiraz ..... F16L 33/30 285/259
6,571,424 B2 6/2003 Roschi
D484,287 S 12/2003 Murphy et al.
D507,854 S 7/2005 Kim
D518,259 S 3/2006 Wertz
D522,197 S 5/2006 Dyson et al.
7,069,620 B2 7/2006 Bagwell
D543,669 S 5/2007 Ikeno et al.
7,222,393 B2 5/2007 Kaffenberger et al.
7,251,856 B2 8/2007 Kaffenberger et al.
D556,963 S 12/2007 Houghton
D596,362 S 7/2009 Crevling, Jr.
D599,065 S 8/2009 Roschi
D605,821 S 12/2009 Shaanan
D613,912 S 4/2010 Benacquisto
7,757,345 B2 7/2010 Roschi et al.
D621,110 S 8/2010 Eden
D621,564 S 8/2010 Kaffenberger
D621,565 S 8/2010 Pierce
D621,567 S 8/2010 Crawley
7,765,638 B2 8/2010 Pineschi et al.
7,797,793 B2 9/2010 Roschi et al.
7,798,177 B1 9/2010 Blair
D649,725 S 11/2011 Fjellman
D652,188 S * 1/2012 Escobar ..... D32/32
D655,468 S 3/2012 Karsan
D670,454 S 11/2012 Sherk, Jr.
D671,283 S 11/2012 Paterson
D672,103 S 12/2012 Dyson
8,769,764 B2 * 7/2014 Crouch ..... A47L 9/0018 15/328
D738,583 S 9/2015 Gidwell
D741,559 S 10/2015 Marscen
D750,858 S 3/2016 Aramli
9,370,287 B2 * 6/2016 Weichert ..... A47L 9/248
D767,224 S 9/2016 Santiago
D770,109 S 10/2016 Chu, Jr.
D770,711 S 11/2016 Okada
D772,510 S 11/2016 Palladino
D775,443 S 12/2016 Kwoon
D778,517 S 2/2017 Perin
D779,951 S 2/2017 Chu
D780,392 S 2/2017 Mikula
D787,766 S 5/2017 Nam
D789,007 S 6/2017 Jang
D793,638 S 8/2017 LaBarbera
D796,136 S 8/2017 Reynolds
D806,964 S 1/2018 Nam
D807,603 S 1/2018 Roschi
10,238,254 B2 3/2019 Roschi
10,443,768 B1 * 10/2019 McConnell ..... F24F 13/02
D869,111 S 12/2019 Chavana, Jr.
D869,112 S 12/2019 Chavana, Jr.
D871,000 S 12/2019 Johnson
D873,516 S 1/2020 Palladino
D877,436 S 3/2020 Ashton-Miller
D900,420 S 10/2020 Roschi
10,816,119 B2 * 10/2020 Sinsel ..... F16L 33/30
D914,306 S 3/2021 Knapp
11,015,749 B2 * 5/2021 Greep ..... A61M 39/1011
D922,014 S 6/2021 Roschi
D924,509 S 7/2021 Niedzwecki
2001/0011404 A1 8/2001 Roschi
2001/0037536 A1 11/2001 Kim
2002/0083552 A1 7/2002 Dilger et al.
2002/0092103 A1 * 7/2002 Bruno ..... A47L 9/244 15/1
2004/0050441 A1 3/2004 Roschi
2005/0132605 A1 6/2005 Jensen et al.
2005/0262659 A1 12/2005 Roschi et al.
2005/0262662 A1 12/2005 Roschi et al.
2005/0268426 A1 12/2005 Lee
2006/0000053 A1 1/2006 Lim et al.
2006/0137134 A1 6/2006 Dilger
2007/0124891 A1 6/2007 Lee
2007/0143954 A1 6/2007 Graham
2007/0169289 A1 7/2007 Hanvey
2010/0319159 A1 12/2010 Gell
2011/0047744 A1 3/2011 Bozzelli
2012/0216361 A1 8/2012 Millington
2012/0312409 A1 * 12/2012 Yamashita ..... A47L 9/242 138/109
2014/0033473 A1 2/2014 McVey
2016/0150927 A1 6/2016 Prosser
2017/0280956 A1 10/2017 Roschi
2017/0319026 A1 11/2017 Roschi
2018/0110201 A1 * 4/2018 Mohyer, Jr. ..... A01K 13/001
2018/0333736 A1 11/2018 Krebs
2019/0167055 A1 * 6/2019 Tahara ..... A47L 9/165
2019/0174981 A1 6/2019 Roschi
2019/0174983 A1 6/2019 Roschi
2019/0200830 A1 * 7/2019 Crouch ..... A47L 5/28
2020/0054180 A1 2/2020 Verhageri
2020/0129025 A1 * 4/2020 Zhong ..... A47L 5/225
2021/0015328 A1 * 1/2021 Wörz ..... A47L 9/24
2021/0161349 A1 6/2021 Davilia
2021/0212532 A1 * 7/2021 Enning ..... A47L 5/38

FOREIGN PATENT DOCUMENTS

DE 23 32 846 1/1975
DE 2332846 A1 * 1/1975 ..... A47L 9/242

(56) References Cited

FOREIGN PATENT DOCUMENTS

| | | | |
|---|---|---|---|
| DE | 84 36 154.9 | | 4/1985 |
| DE | 89 01 995 | U1 | 8/1990 |
| DE | 40 28 113 | A | 3/1992 |
| DE | 41 05 012 | | 10/1992 |
| DE | 44 13 071 | | 10/1995 |
| DE | 296 08 726 | U | 7/1996 |
| DE | 196 17 415 | A | 11/1997 |
| DE | 19704796 | C1 | 1/1998 |
| DE | 19906137 | C1 | 7/2000 |
| DE | 199 12 651 | | 9/2000 |
| DE | 10307176.8 | | 2/2003 |
| EP | 0 235 614 | | 9/1987 |
| EP | 0 315 068 | | 5/1989 |
| EP | 0 552 652 | A | 7/1993 |
| EP | 0 630 604 | A | 12/1994 |
| EP | 0 737 437 | A | 10/1996 |
| EP | 0 909 548 | A | 4/1999 |
| EP | 1 031 312 | | 8/2000 |
| EP | 1116470 | A1 | 7/2001 |
| EP | 1210898 | A1 | 6/2002 |
| EP | 1 238 620 | A | 9/2002 |
| EP | 1 310 202 | | 5/2003 |
| EP | 1 367 931 | B1 | 8/2004 |
| EP | 1 600 091 | | 11/2005 |
| EP | 1 600 091 | A1 | 11/2005 |
| EP | 1595485 | A1 | 11/2005 |
| EP | 1 964 501 | | 9/2008 |
| EP | 2 092 869 | | 8/2009 |
| EP | 2449934 | A2 | 5/2012 |
| EP | 2 944 242 | | 11/2015 |
| EP | 2 944 242 | A1 | 11/2015 |
| EP | 2 995 234 | | 3/2016 |
| EP | 3 047 775 | | 7/2016 |
| EP | 3 087 890 | | 11/2016 |
| EP | 3 207 848 | | 8/2017 |
| FR | 578087 | | 3/1924 |
| FR | 1140810 | | 2/1956 |
| FR | 2 483 766 | A | 12/1981 |
| GB | 2 072 495 | A | 10/1981 |
| GB | 2 202 026 | A | 9/1988 |
| GB | 2 471 918 | | 1/2011 |
| GB | 2 496 663 | | 5/2013 |
| JP | 3-149489 | | 3/1991 |
| JP | 08 322766 | | 4/1997 |
| JP | D1581451 | | 7/2017 |
| WO | 99/65376 | | 12/1999 |
| WO | WO 00/65978 | | 11/2000 |
| WO | WO 01/97673 | | 12/2001 |
| WO | 02/26097 | | 4/2002 |
| WO | 02/071911 | | 9/2002 |
| WO | WO 2005/096907 | | 10/2005 |

OTHER PUBLICATIONS

Search Report for IT102020000001555, dated Jul. 17, 2020, 2 pages.

EP Search Report complete May 2, 2005 in corresponding IT application No. IT MI20041075.

EP Search Report completed May 2, 2005 in corresponding IT application No. IT MI20041074.

International Search Report dated Sep. 25, 2006 in PCT Application PCT/EP2006/005634.

Written Opinion of the International Searching Authority dated Sep. 25, 2006 in PCT Application PCT/EP2006/005634.

English translation of EP 2449934A2 provided by EspaceNet.

European Standard EN 60312-1, Vacuum cleaners for household use—Part 1: Dry vacuum cleaners—Methods for measuring the performance (IEC 603121-1:2010, modified + A1:2011, modified) Feb. 2017.

Search Report for IT UA20163223 dated Nov. 23, 2016, 2 pages.

Japanese Notice of List of References dated May 15, 2018 in JP design application 2018-001065.

EN 60312-1, European Standard, CENELEC, EP Committee for Electrotechnical Standardization, "Vacuum cleaners for household use—Part 1: Dry vacuum cleaners—Methods for measuring the performance" (IEC 60312-1:2010, modified + A1:2011, modified) © 2017 CENELEC.

Notice of Allowance dated Feb. 12, 2021 in Design U.S. Appl. No. 29/683,960.

https://www.amazon.com/Penn-Plax-VacGroom-Grooming-Attachment/dp/B01ACBHME1/ref=sr_1_2 (Year: 2020).

Design U.S. Appl. No. 29/746,547, filed Aug. 14, 2020, entitled "Head of a Vacuum Cleaner".

* cited by examiner

ADAPTER DEVICE FOR A CORDLESS ELECTRIC VACUUM CLEANER

This application claims priority to IT Patent Application No. 102020000001555 filed 28 Jan. 2020, the entire contents of which is hereby incorporated by reference.

BACKGROUND

The present invention relates to the field of vacuum cleaning appliances, such as a vacuum cleaner, an electric broom or a vacuum cleaner, for sucking dust and/or fluids and/or debris from a surface. More particularly, it relates to an adapter device for connecting the motor unit of a wireless electric vacuum cleaner to a flexible tube or to an accessory.

STATE OF THE ART

In the present description and in the claims, the term "vacuum cleaner" will be used with a wide meaning so as to include all the apparatus, for professional or domestic use, for cleaning by suction. Therefore, the term "vacuum cleaner" will comprise a vacuum cleaner, an electric broom, a so-called vacuum cleaner bin or also an industrial plant of the type in use at car washes or service stations.

Thanks to the performance achieved by electric motors and energy storage batteries, wireless electric brooms have become widespread in recent years. Such apparatuses are very practical and offer high suction performance, even higher than those of traditional wire apparatuses. In fact, such apparatuses are light and, being without a cable for connection to a power outlet, can be used for any area of the working environment, freely and without interruptions. They do not have constraints related to the length of the cable as in wire appliances.

Wireless electric broom manufacturers often feel free to design their own appliances in unusual and unconventional shapes. This is in order to characterize its own devices with respect to those of competitor manufacturers and also to discourage the production of non-original parts and accessories.

Many electric brooms, for example, comprise a main body housing the motor unit, the batteries, the other electrical and electronic components and a container for collecting the sucked dirt. Typically, this main body is connected to a rigid tube which terminates at the bottom at a brush (or suction head).

DE 23 32 846 A1 discloses a vacuum cleaner hose connection.

SUMMARY OF THE INVENTION

While the use of an electric broom of the above type is very practical, the Applicant has found that it is very difficult, or certainly not practical, to use the electric broom to suck sofas, seats of vehicles or narrow environments (for example drawers or furniture, or the interior of vehicles). It would be equally difficult to use a wireless electric broom with an accessory to brush a pet by sucking the hairs.

There is no possibility of connecting the main body of an electric broom to an accessory directly or through a flexible tube.

Moreover, as mentioned above, the fact that electric broom manufacturers design their products in full freedom often leads to tubes of different cross-section from that of conventional vacuum cleaners, both in terms of shape and size. For example, tubes of quadrangular cross-section are known. This fact often makes it impossible, for example, to connect a standard hose to the main body of a wireless electric broom.

The Applicant has set itself the object of providing a device for connecting an accessory or a hose to the motor unit of a wireless electric broom.

According to a first aspect, the present invention provides an adapter device for a vacuum cleaner comprising a hollow tubular body with a first end configured to engage the main body of the vacuum cleaner and a second end configured to engage an accessory or a flexible hose, wherein said adapter device is at least partially of a resilient material.

According to a first aspect of the invention, there is provided an adapter device for a vacuum cleaner comprising a hollow tubular body comprising a first end configured to engage a part of the vacuum cleaner and a second end configured to engage an accessory or a flexible tube, wherein the hollow tubular body is at least partially of a deformable material with elastic return and comprises a ring protruding radially outwards from the external surface of the tubular body.

According to embodiments, the adapter device comprises a plurality of rings protruding radially outwards from the external surface of the tubular body, wherein the rings of the plurality of rings have an increasing diameter.

According to embodiments, the rings of the plurality of rings have a substantially circular shape.

According to embodiments, the first end is substantially cylindrical with a substantially circular section.

According to embodiments, the second end is at least partially conical.

According to embodiments, the second end which is at least partially conical comprises three substantially conical sections.

According to embodiments, the substantially conical sections have different taper angles.

According to embodiments, the adapter device is made at least partially of a material chosen from the group comprising: natural rubber, synthetic rubber, thermoplastic elastomer, thermoplastic polyurethane, polyvinyl chloride, or any combination thereof.

According to a second aspect, the present invention provides a vacuum cleaner comprising an adapter device as set forth above, wherein the vacuum cleaner is a cordless electric vacuum cleaner or an industrial vacuum cleaner for gas stations or car washes.

According to a third aspect, the present invention provides a kit of parts comprising an adapter device as set forth above and one or more of the following parts: a flexible tube, a rigid nozzle, a brush, a rigid curve, a suction head, a pet grooming tool.

BRIEF DESCRIPTION OF THE FIGURES

The present invention will become clearer from the following description, given as a non-limiting example, to be read with reference to the enclosed drawings, in which.

DETAILED DESCRIPTION

Figure 2:
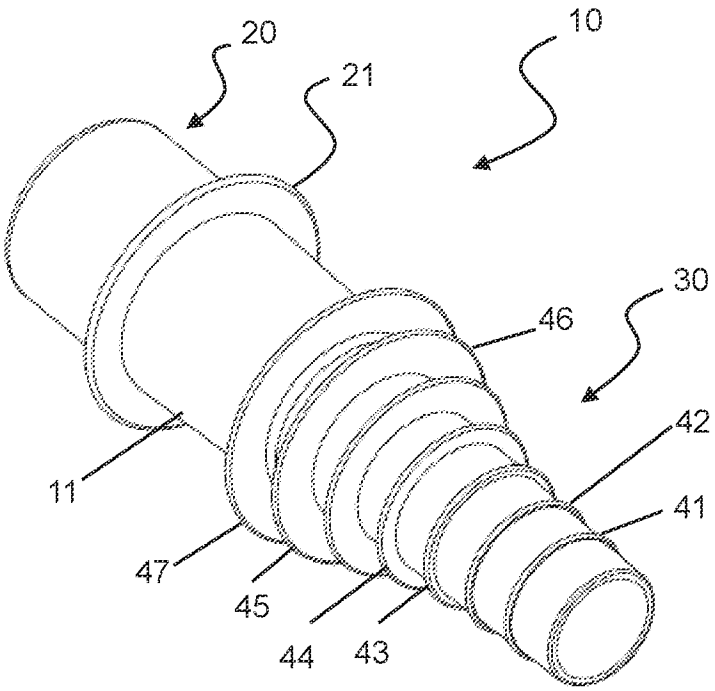
FIG. 2 is a second axonometric view of the adapter device of FIG. 1.
Figure 1:
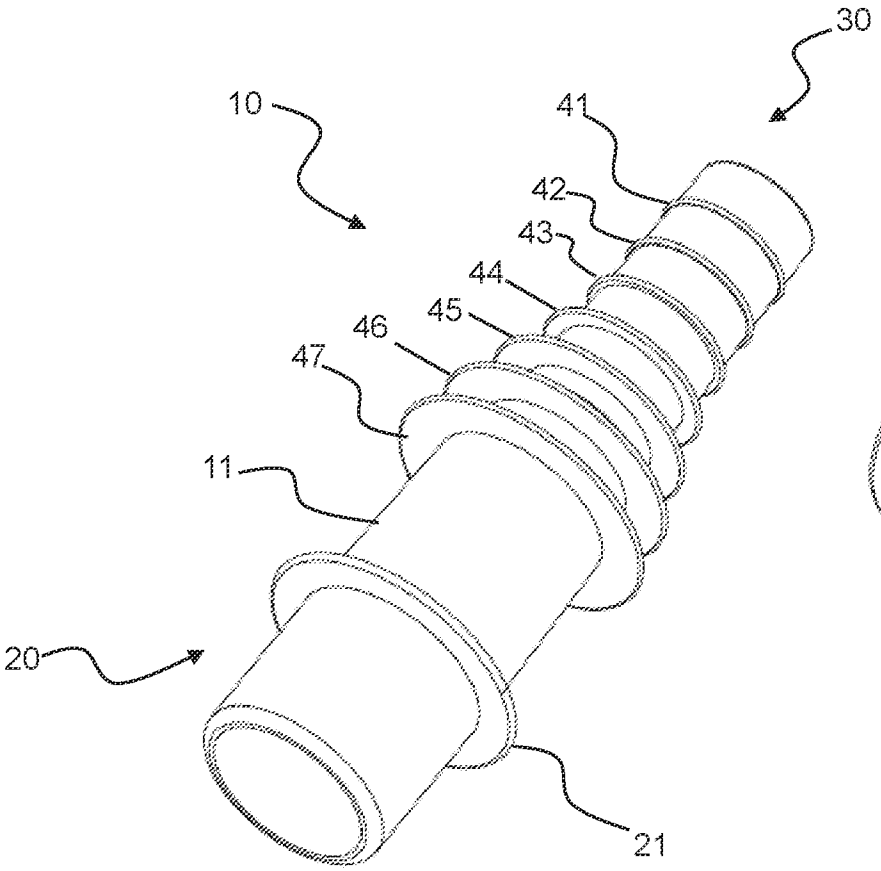
FIG. 1 is a first axonometric view of an adapter device according to an embodiment of the present invention.

FIGS. 1-5 show an embodiment of an adapter device 10 of the invention.

The adapter device 10 comprises a hollow tubular body 11. Preferably, the hollow tubular body 11 is made at least partially of a deformable elastic return material. For example, it can be made of rubber, natural or synthetic, or of a thermoplastic elastomer (TPE), or of a thermoplastic polyurethane (TPU), or of polyvinyl chloride (PVC), or any combination thereof. For the purpose of the present description, the term "elastic return deformable material" means a material which can be deformed by a healthy adult using only one hand, without excessive effort and which is able to return substantially to the original configuration at the end of the deformation in a few seconds or in any case within 300 seconds.

Preferably, the deformable elastic return material has a hardness of between about 40 Shore A and about 100 Shore A. More preferably, comprised between about 50 Shore A and about 90 Shore A. Even more preferably comprised between about 60 Shore A and about 80 Shore A. According to embodiments it is between about 65 Shore A and about 75 Shore A, for example about 70 Shore A.

The hollow tubular body 11 comprises a first end 20 configured to engage the main body 51 of a vacuum cleaner 50 and a second end 30 configured to engage an accessory or a hose.

The first end 20 is preferably substantially cylindrical or with a very low taper, mainly necessary for manufacturing reasons. Preferably it has a substantially circular cross-section. According to embodiments, the first end 20 may have a diameter of about 30-40 mm. Preferably, it has a diameter of about 33-37 mm and more preferably has a diameter of about 35 mm.

The second end 30 is preferably conical.

According to embodiments, the second end 30 has a single taper, i.e. it uniformly increases its diameter in the direction toward the first end 20.

According to other embodiments, the second end 30 has two different tapers, i.e. two sections can be identified in which the diameter increases differently in the direction toward the first end 20.

According to still other embodiments, the second end 30 has three different tapers, i.e. three sections 31, 32, 33 can be identified in which the diameter increases in a different way in the direction toward the first end 20. This embodiment is shown in particular in FIG. 3.

According to other embodiments, the second end 30 has a taper number greater than three.

Figure 3:
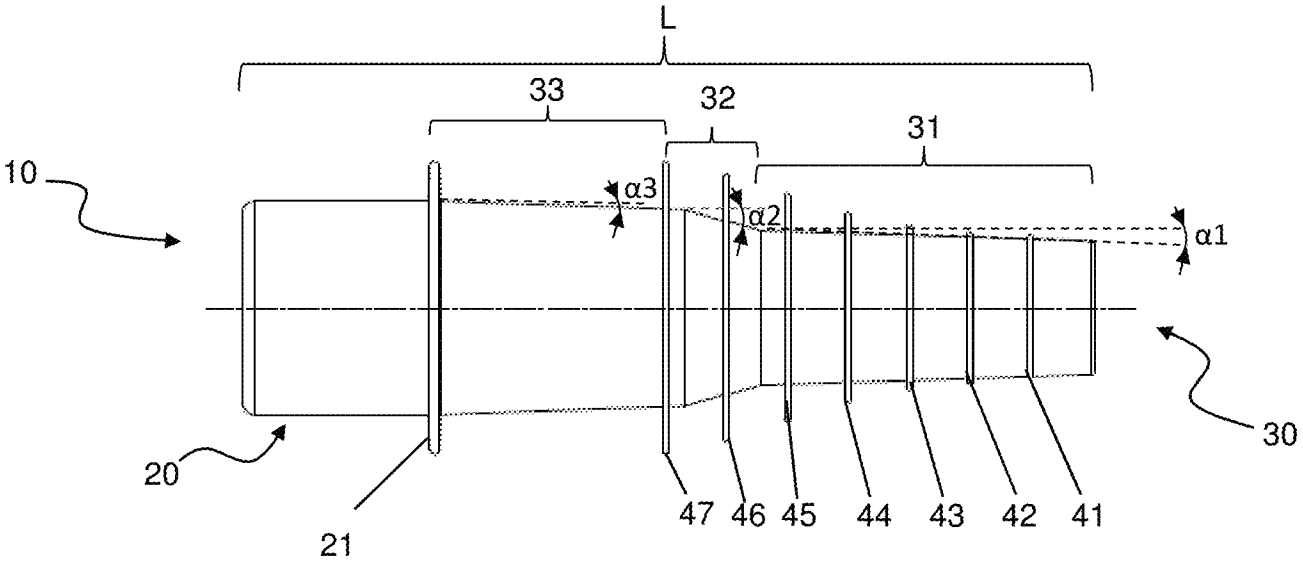
FIG. 3 is a side plan view of the adapter device of FIGS. 1 and 2.
Figure 5:
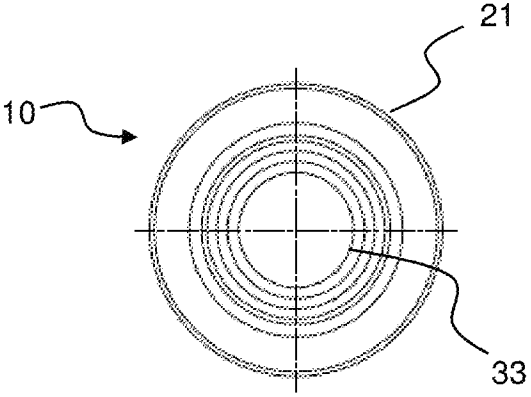
FIG. 5 is a view from the second end of the adapter device of FIGS. 1-3.
Figure 4:
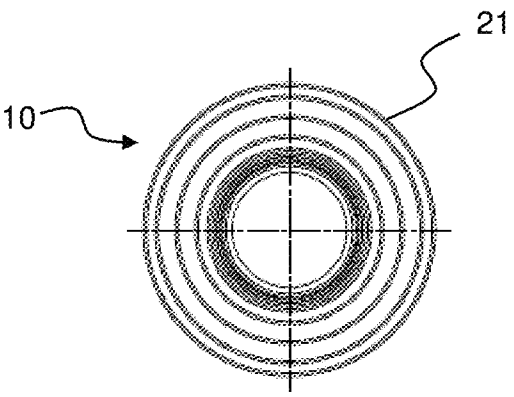
FIG. 4 is a view from the first end of the adapter device of FIGS. 1-3.
Figure 6:
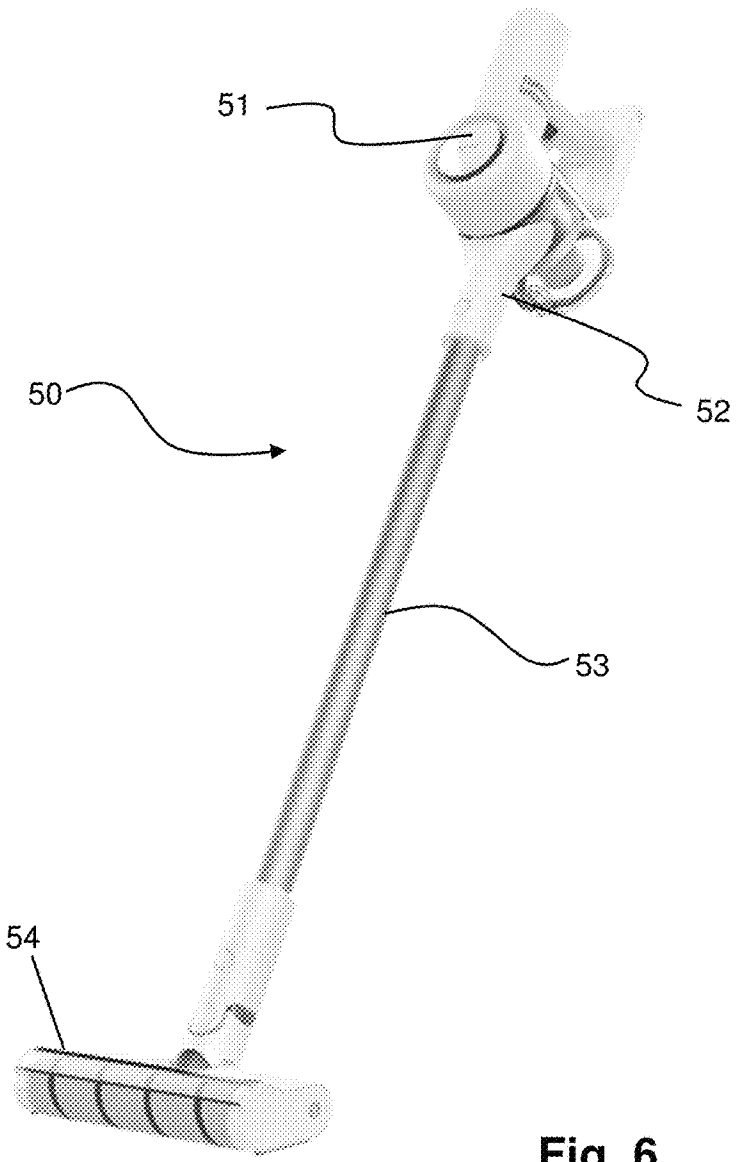
FIG. 6 is an exemplary image of a known electric cordless vacuum cleaner.

With reference to the various figures but in particular to FIG. 3, the embodiment will be described in which the second end 30 comprises three sections, each with a different angle of taper. A first portion 31 has a diameter which increases with a first taper angle $\alpha 1$ (alpha 1) comprised between about 0° and about 5.5°, preferably comprised between about 1° and about 3.5°, more preferably comprised between about 1° and about 2.5°. According to embodiments, the first taper angle $\alpha 1$ is between about 1.5° and about 2°, for example 1.8°. A second section 32 (intermediate) has a diameter which increases with a second taper angle $\alpha 2$ (alpha two) comprised between about 7° and about 25°, preferably comprised between about 9° and about 22°, more preferably comprised between about 12° and about 20°. According to embodiments, the second taper angle $\alpha 2$ is comprised between about 14° and about 18°, for example 16°. A third section 33 has a diameter which increases with a third taper angle $\alpha 3$ (alpha three) comprised between about 0.5° and about 5°, preferably comprised between about 1° and about 4°, more preferably comprised between about 1° and about 3°. According to embodiments, the third taper angle $\alpha 3$ is comprised between about 1.5° and about 2.5°, for example 2°.

Preferably, the second taper angle $\alpha 2$ is greater than both the first taper angle $\alpha 1$ and the third taper angle $\alpha 3$. In turn, the first taper angle $\alpha 1$ is preferably greater than the third taper angle $\alpha 3$.

Preferably, the first section 31 of the second end 30 has a length greater than the second section 32 and the third section 33. Preferably, the second intermediate section 32 has a length less than the other two sections 31, 33.

The smaller diameter of the first section 31 can be about 20-25 mm, preferably about 21-24 mm and more preferably about 22 mm.

The hollow tubular body 11 can have a length L of about 100-200 mm, for example about 120-160 mm. Preferably it has a length of about 140 mm.

According to preferred embodiments, the hollow tubular body 11 comprises a plurality of sealing rings (41-47) projecting radially outward from the outer surface of the tubular body. Preferably, the sealing rings 41-47 have a substantially circular flattened shape. Preferably, the rings 41-47 are integral with the outer surface of the hollow tubular body.

According to the embodiment shown in the figures, the sealing rings 41-47 are substantially at 90° with respect to the axis of the tubular body. However, in other embodiments not shown, they could be inclined to form an angle greater than 90° or less than 90° to facilitate insertion or extraction.

Preferably, the first section 31 of the second end 30 comprises a plurality of rings 41-44 of uniformly increasing diameter and a ring 45 of greater diameter near the second portion 32.

Preferably, the second portion 32 of the second end 30 comprises a single ring 46, preferably about in the middle of the second portion 32.

Preferably, the third portion 33 of the second end 30 comprises a single ring 47, preferably close to the second portion 32.

Preferably, the rings of the three sections of the second end are substantially equally spaced apart.

Preferably, the rings 41-47 of the three sections 31-33 of the second end 30 have a thickness substantially equal to each other.

Preferably, a further sealing ring 21 or shoulder is provided between the first end 20 and the second end 30.

Preferably, the further sealing ring 21 has a diameter substantially equal to the diameter of the sealing ring 47 of the third section 33 but may have a greater thickness. This is because the further sealing ring 47 acts as a shoulder or abutment for the end edge of the flexible tube to which the adapter 10 is associated.

In use, therefore, the first end 20 of the adapter 10 according to the present invention is inserted into the end of a hose or an accessory. The second end 30 of the adapter 10 is instead inserted in the tube stump 52 of the main body 51 of the vacuum cleaner 50. Depending on the shape and size of the latter, only the first section 31, or the first section 31 and the second section 32 or all three sections 31-33 of the second end of the adapter 10 are inserted. The soft material of the adapter 10 allows it to adapt substantially to any shape and size of the tube 52 of the main body 51. The rings 41-47 projecting from the outer surface of the cylindrical body 11 advantageously act as a plug, i.e. they form an air seal and therefore considerably limit the load losses, maintaining the suction efficiency substantially at the nominal value.

The adapter 10 according to the present invention may be provided as a separate piece, may be provided in association with the vacuum cleaner 50 or may be part of a kit. The kit may comprise the adapter 10 and one or more of the following parts: A hose, a rigid nozzle, a brush, a rigid bend, a suction head or a pet grooming brush.

The adapter 10 of the present invention is particularly suitable to be used in association with a wireless electric vacuum cleaner 50 (also called "electric broom") but it can also be used for other vacuum cleaners. In particular, it can be used to connect the rigid nozzle of an industrial vacuum cleaner installed in a car wash or in a gas station to his/her own accessory or to his/her own hose. This makes it possible to use the industrial car wash vacuum cleaner better, more efficiently and more hygienically. In fact, the flexible tube and the rigid nozzle of an industrial vacuum cleaner installed in a car wash is used by a plurality of people, generally without great care by the users, to suck also earth, stones, oil and liquids of various types, . . . . The use of the nozzle and of the hose provided to the industrial vacuum cleaner is therefore anti-hygienic and risks to render more dirty the interior of the vehicle.

The adapter 10 of the present invention allows to connect to the rigid nozzle or to the hose provided in the car wash a hose and/or an accessory thereof (for example of the above kit). The hose and accessories of the user are certainly cleaner and hygienically safer. Once the work is complete, it is sufficient to detach the adapter 10 and his/her own hose or his/her own accessory.

The invention claimed is:

1. A kit of parts comprising:

an adapter device for a vacuum cleaner comprising a hollow tubular body, the tubular body comprising:

a first end configured to be inserted into a tube stump of a main body of the vacuum cleaner;

a second end configured to be inserted into an end of a hose or an accessory; and a first ring provided between the first end and the second end;

wherein said hollow tubular body comprises a deformable material with elastic return;

wherein said second end comprises a plurality of second rings protruding radially outwards from the external surface of the second end of the tubular body;

wherein the second rings have a substantially circular shape;

wherein the second rings have an increasing diameter; and, wherein the second rings are flat and each second ring is of constant thickness throughout the respective second ring;

wherein the second end is conical and comprises a first section with a first angle of taper, and wherein a truncated cone surface is provided between two adjacent second rings which protrude radially outwards from the first section of the second end; and one or more of the following parts into which the second end is configured to be inserted: a flexible tube, a rigid nozzle, a brush, a rigid curve, a suction head, and a pet grooming tool.

2. An adapter device for a vacuum cleaner comprising a hollow tubular body having a longitudinal axis comprising:

a first cylindrical end configured to be inserted into a tube stump of a main body of the vacuum cleaner;

a second conical end configured be inserted into an end of a hose or an accessory; and a first ring arranged between the first cylindrical end and the second conical end;

wherein said hollow tubular body comprises a deformable material with elastic return;

wherein said second conical end comprises a plurality of second rings protruding radially outwards from the external surface of the second conical end of the tubular body;

wherein the second rings have a substantially circular shape;

wherein the second rings have an increasing diameter;

wherein the second rings are flat and each second ring is of constant thickness throughout the respective second ring;

wherein the second conical end comprises a first conical section with a first angle of taper, a second conical section with a second angle of taper and a third conical section with a third angle of taper, wherein the second angle of taper is greater than the first angle of taper and the third angle of taper.

3. The adapter device of claim 2 wherein a truncated cone surface is provided between two adjacent second rings which protrude radially outwards from the first section of the second end.

4. The adapter device of claim 2, wherein the rings are substantially at 90° with respect to an axis of the tubular body.

5. The adapter device of claim 2, wherein the first taper angle is greater than the third taper angle.

6. The adapter device of claim 2, wherein said first ring has a first thickness which is greater than the thickness of the second rings.

7. An adapter device for a vacuum cleaner comprising a hollow tubular body having a longitudinal axis, the adapter device comprising:

a first end configured to be inserted into a tube stump of a main body of the vacuum cleaner;

a second end configured to be inserted into an end of a hose or an accessory; and a first ring provided between the first end and the second end;

wherein said hollow tubular body comprises a deformable material with elastic return;

wherein said second end comprises a plurality of second rings protruding radially outwards from the external surface of the second end of the tubular body;

wherein the second rings have a substantially circular shape;

wherein the second rings have an increasing diameter;

wherein the second rings are flat and each second ring is of constant thickness throughout the respective second ring;

wherein the second end is conical and comprises a first section with a first angle of taper, and wherein a truncated cone surface is provided between two adjacent second rings which protrude radially outwards from the first section of the second end.

8. The adapter device of claim 7, wherein the second rings of the plurality of second rings have a uniformly increasing diameter.

9. The adapter device of claim 7, wherein said first end has a substantially circular section and wherein said first ring has a first thickness which is greater than the thickness of the second rings.

10. The adapter device of claim 7, wherein the adapter device comprises natural rubber, synthetic rubber, thermoplastic elastomer, thermoplastic polyurethane, or any combination thereof.

11. The adapter device of claim 7, wherein the rings are substantially at 90° with respect to an axis of the tubular body.

12. The adapter device of claim 7, wherein the first ring is flat with a constant thickness throughout the first ring.

13. The adapter device of claim 7, wherein said second end comprises the first conical section, a second conical section, and a third conical section.

14. The adapter device of claim 13, wherein the first conical section has an angle of taper less than about 5.5°, the second conical section has an angle of taper between about 7° and about 22°, and the third conical section has an angle of taper between 0.5° and about 5°.

* * * * *